US009976739B2

(12) United States Patent
Kainu et al.

(10) Patent No.: US 9,976,739 B2
(45) Date of Patent: May 22, 2018

(54) AIR NOZZLE ARRANGEMENT IN A FLUIDIZED BED BOILER, GRATE FOR A FLUIDIZED BED BOILER, AND A FLUIDIZED BED BOILER

(71) Applicant: Valmet Technologies Oy, Espoo (FI)

(72) Inventors: Vesa Kainu, Kangasala (FI); Jukka-Pekka Leppälä, Tampere (FI)

(73) Assignee: Valmet Technologies Oy, Espoo (FI)

( * ) Notice: Subject to any disclaimer, the term of this patent is extended or adjusted under 35 U.S.C. 154(b) by 319 days.

(21) Appl. No.: 14/442,378

(22) PCT Filed: Nov. 7, 2013

(86) PCT No.: PCT/FI2013/051049
§ 371 (c)(1),
(2) Date: May 12, 2015

(87) PCT Pub. No.: WO2014/076365
PCT Pub. Date: May 22, 2014

(65) Prior Publication Data

US 2015/0316255 A1 Nov. 5, 2015

(30) Foreign Application Priority Data

Nov. 13, 2012 (FI) ..... 20126187

(51) Int. Cl.

| | |
|---|---|
| ***F23C 10/20*** | (2006.01) |
| ***F23L 1/02*** | (2006.01) |
| ***F23L 9/06*** | (2006.01) |
| ***F23H 3/02*** | (2006.01) |
| ***F23C 10/24*** | (2006.01) |

(52) U.S. Cl.
CPC ..... *F23C 10/20* (2013.01); *F23C 10/24* (2013.01); *F23H 3/02* (2013.01); *F23L 1/02* (2013.01); *F23L 9/06* (2013.01); *F23C 2900/10007* (2013.01)

(58) Field of Classification Search
CPC .... F23C 10/18; F23C 10/20; F23J 1/00; B01J 8/44
USPC ..... 422/139
See application file for complete search history.

(56) References Cited

U.S. PATENT DOCUMENTS

| | | | | |
|---|---|---|---|---|
| 4,780,966 | A | 11/1988 | Harding | |
| 4,854,854 | A | 8/1989 | Jonsson | |
| 5,425,331 | A * | 6/1995 | Abdulally | F22B 31/0061 110/245 |
| 5,966,839 | A * | 10/1999 | Pohja | F23C 10/20 34/578 |
| 6,203,761 | B1 * | 3/2001 | Paatz | B01J 2/16 34/585 |
| 8,714,094 | B2 * | 5/2014 | Bober | F23C 10/20 110/243 |
| 2007/0245935 | A1 * | 10/2007 | Etelaaho | F23C 10/20 110/243 |

FOREIGN PATENT DOCUMENTS

| | | |
|---|---|---|
| DE | 20213861 U1 | 11/2002 |
| EP | 0028458 A2 | 5/1981 |
| WO | 2014076365 A1 | 5/2014 |

OTHER PUBLICATIONS

International Search Report for PCT/FI2013/051049 dated Jan. 21, 2014.
Written Opinion of the International Searching Authority for PCT/FI2013/051049 dated Jan. 21, 2014.
Written Opinion of the International Preliminary Examining Authority for PCT/FI2013/051049 dated Oct. 21, 2014.
Written Opinion of the International Preliminary Examining Authority for PCT/FI2013/051049 dated Jan. 15, 2015.
International Preliminary Report on Patentability for PCT/FI2013/051049 dated Mar. 19, 2015.
Search Report for FI20126187 dated Jul. 30, 2013.

* cited by examiner

*Primary Examiner* — Jorge Pereiro
(74) *Attorney, Agent, or Firm* — Stiennon & Stiennon

(57) ABSTRACT

An air nozzle arrangement for a fluidized bed boiler, comprising an air feed pipe and an air nozzle which limit an air feed duct configured to supply air to the furnace of the fluidized bed boiler. The air nozzle arrangement comprises a surface configured to guide coarse material along said surface. At least part of said surface is thermally insulated from the air nozzle and/or the air feed pipe. Furthermore, at least part of said surface is configured to protect at least part of said air nozzle and/or air feed pipe. Thus, the temperature of said surface is configured to be high when the fluidized bed boiler is in operation, whereby the solidification of molten material of the fluidized bed in the air nozzle arrangement is reduced.

14 Claims, 8 Drawing Sheets

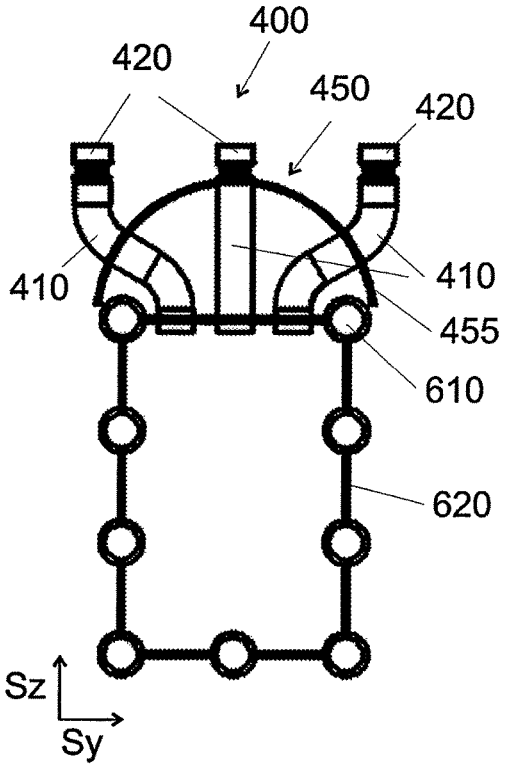
Fig. 4a
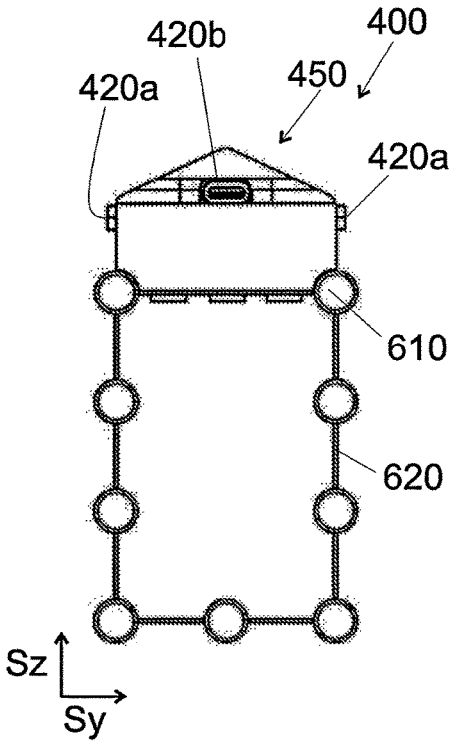
Fig. 4b1
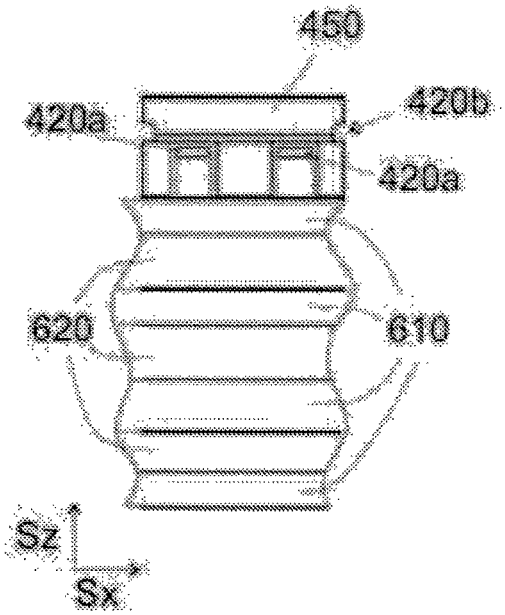
Fig. 4b2
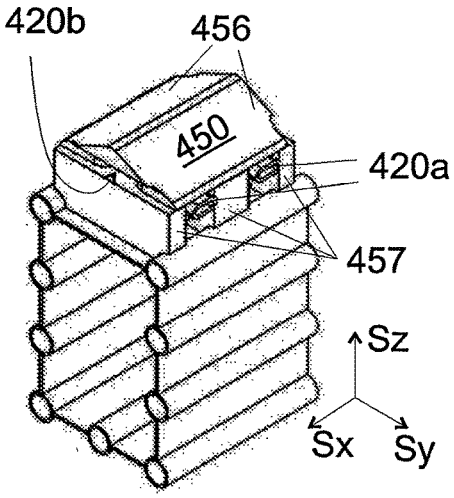
Fig. 4b3

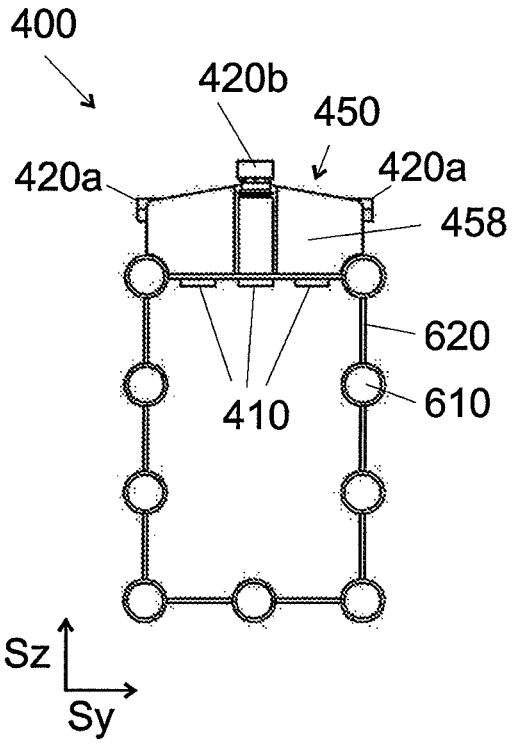
Fig. 4c1
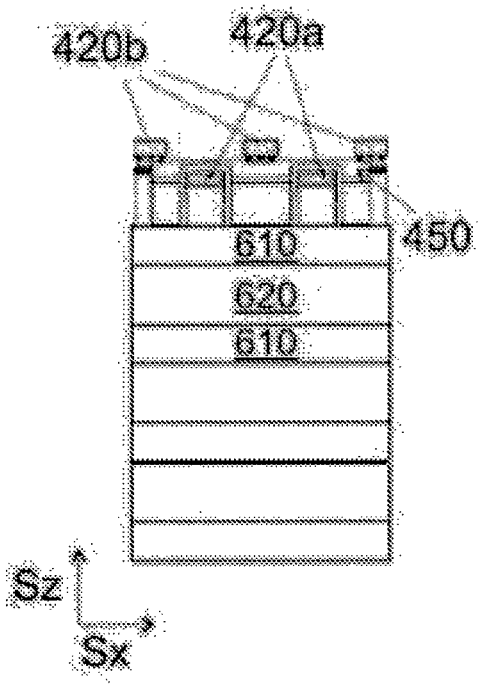
Fig. 4c2
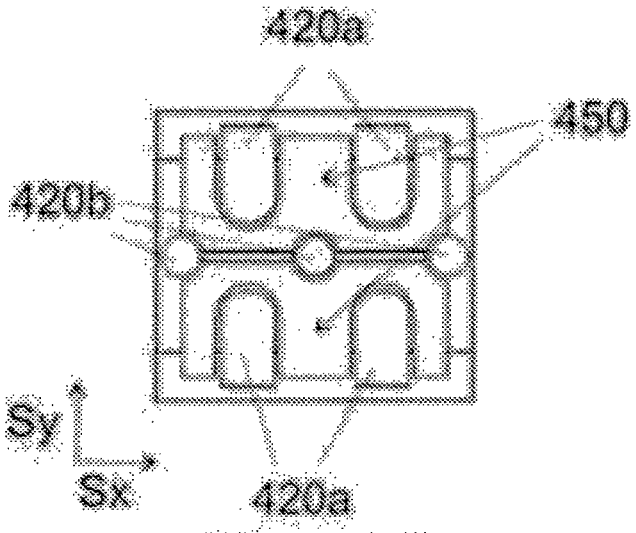
Fig. 4c3

AIR NOZZLE ARRANGEMENT IN A FLUIDIZED BED BOILER, GRATE FOR A FLUIDIZED BED BOILER, AND A FLUIDIZED BED BOILER

CROSS REFERENCES TO RELATED APPLICATIONS

This application is a U.S. national stage application of International Application PCT/FI2013/051049, filed Nov. 7, 2013, and claims priority on Finnish Application 20126187, filed Nov. 13, 2012, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an air nozzle arrangement in a fluidized bed boiler. The invention also relates to a grate for a fluidized bed boiler. The invention also relates to a fluidized bed boiler. The invention also relates to a method for removing coarse material from a fluidized bed boiler.

A fluidized layer refers to a layer formed by solid and granular substance, where the grains of the solid substance are in a fluidized state. The fluidized state can be achieved, for example, by fluidizing the grains by means of a fluidizing gas flow. The fluidized layer is formed in a fluidized bed reactor, which has been or is supplied with said granular solid substance. The fluidized bed reactor can be supplied with fluidizing gases from below, for fluidizing the solid substance. The fluidized layer can also be called a fluidized bed.

A fluidized bed boiler is an application of the fluidized bed. The fluidized bed boiler comprises a furnace for burning combustible material. In fluidized bed boilers, said solid substance (i.e. coarse material) comprises combustible material, burnt material, and non-combustible material, i.e. bed material, such as for example sand. In the fluidized bed boiler, the fluidized bed is formed of both the combustible material and the bed material by fluidizing with a fluidizing gas. The fluidizing gas in the fluidized bed boiler comprises oxygen. The fluidizing gas is introduced into the fluidized bed boiler via, for example, air nozzles. Heat formed in the combustion is effectively transferred to the bed material. From the bed material, heat can be recovered by a heat transfer surface, such as a heat exchanger, the heat transfer surface typically comprising heat exchanger pipes. Because the function of the heat transfer surfaces is to recover heat, heat transfer with the heat transfer surfaces of prior art is efficient. Thus, the heat transfer surface is typically clearly cooler than the bed, because the heat transfer surface is cooled by means of a heat transfer medium.

Fluidized bed boilers utilizing a bubbling fluidized bed (BFB) and a circulating fluidized bed (CFB) are known e.g. from U.S. Pat. Nos. 5,966,839A, 4,780,966A, and EP 0,028,458.

U.S. Pat. No. 5,966,839A discloses a grate assembly for a fluidized bed boiler. The grate assembly comprises means, through which cooling air is directed to a combustion chamber in the fluidized bed. The means are formed of a tubular supply channel and a substantially horizontal protective sheet at the upper end of the supply channel.

U.S. Pat. No. 4,780,966A discloses a fluidized bed comprising a sparge pipe assembly such as pipes. That invention aims to prevent unacceptable temperature differences between the upper and lower sections of the sparge pipe wall, which temperature difference results in problems of differential thermal expansion along the axis of the sparge pipe which may cause lateral buckling or distortion. In the solution, the upper section of the sparge pipe is insulated from high heat transfer, e.g. by covering the sparge pipe with a layer of denser and/or coarser particles that do not become fluidized at any fluidizing gas flow rates, and/or by protecting the upper section of the sparge pipe by a thermal insulator from the active or fluidized region of the bed.

EP 0,028,458 relates to fluidized bed boilers and burners. It provides a fluidized bed burner having a base plate with upstanding combustion air stand pipes in which at least some of the stand pipes include or have associated therewith air flow control devices. Each standpipe has its upper end blanked off and has holes in the sides. The upper ends are blanked off by an umbrella plate.

A problem in the boilers is the congealing of molten material to solid state. For example, some metals may be present in liquid state in the furnace of the fluidized bed boiler. When coarse material is removed from the boiler, heat can be recovered from the coarse material, wherein the coarse material cools down. Thus, said liquid metal solidifies. Metal can solidify, for example, in said air nozzles of the fluidized bed boiler. This can cause non-uniformness in the supply of fluidizing air.

The non-uniformnesss in the supply may impair the combustion, for example because of an insufficient supply of combustion air or excessive non-uniformness in the supply of combustion air. Furthermore, the process control may become difficult, if part of the nozzles is clogged.

SUMMARY OF THE INVENTION

It has been found that the presented problems can be reduced by a novel air nozzle arrangement for a fluidized bed boiler.

An air nozzle arrangement according to an embodiment for a fluidized bed boiler comprises

- an air feed pipe and an air nozzle limiting an air feed duct,
- the air nozzle being connected to the air feed pipe,
- the air feed duct being configured to supply air to the furnace of the fluidized bed boiler.

The air nozzle arrangement further comprises

- a surface configured to guide coarse material along said surface, in which arrangement
- at least part of said surface is thermally insulated from
  - the air nozzle,
  - the air feed pipe, or
  - the air nozzle and the air feed pipe, and
- at least part of said surface is configured to protect at least part of
  - the air nozzle,
  - the air feed pipe, or
  - the air nozzle and the air feed pipe.

Thus, the temperature of said surface is configured to be high when the fluidized bed boiler is in operation, whereby the solidification of liquid material of the fluidized bed in the air nozzle arrangement is reduced.

The air nozzle arrangement can be configured in a grate beam of the fluidized bed boiler. The grate of the fluidized bed boiler may comprise such grate beams or such air nozzle arrangements. The fluidized bed boiler can comprise such a grate, such grate beams, or such air nozzle arrangements.

By means of the air nozzle arrangement, it is possible to remove coarse material from the fluidized bed boiler. In a method for removing coarse material from a fluidized bed boiler, the fluidized bed boiler comprises an air nozzle, an air feed pipe, a grate, and an ash removal zone or a coarse material outlet.

The method comprises supplying air by an air nozzle to the furnace of the fluidized bed boiler, and removing coarse material from the fluidized bed boiler via the ash removal zone or the coarse material outlet, guiding the coarse material along the surface towards said ash removal zone or coarse material outlet, at least part of the surface being thermally insulated from at least one of the following: the air nozzle and the air feed pipe, and protecting at least part of the air nozzle and/or the air feed pipe by means of said surface.

BRIEF DESCRIPTION OF THE DRAWINGS

FIG. 4*a* shows an air nozzle arrangement in an end view.

FIG. 4*b*1 shows an air nozzle arrangement in an end view.

FIG. 4*b*2 shows the air nozzle arrangement of FIG. 4*b*1 in a side view.

FIG. 4*b*3 shows the air nozzle arrangement of FIG. 4*b*1 in a perspective view.

FIG. 4*c*1 shows an air nozzle arrangement in an end view.

FIG. 4*c*2 shows the air nozzle arrangement of FIG. 4*c*1 in a side view.

FIG. 4*c*3 shows the air nozzle arrangement of FIG. 4*c*1 in a top view.

DESCRIPTION OF THE PREFERRED EMBODIMENTS

Figure 1:
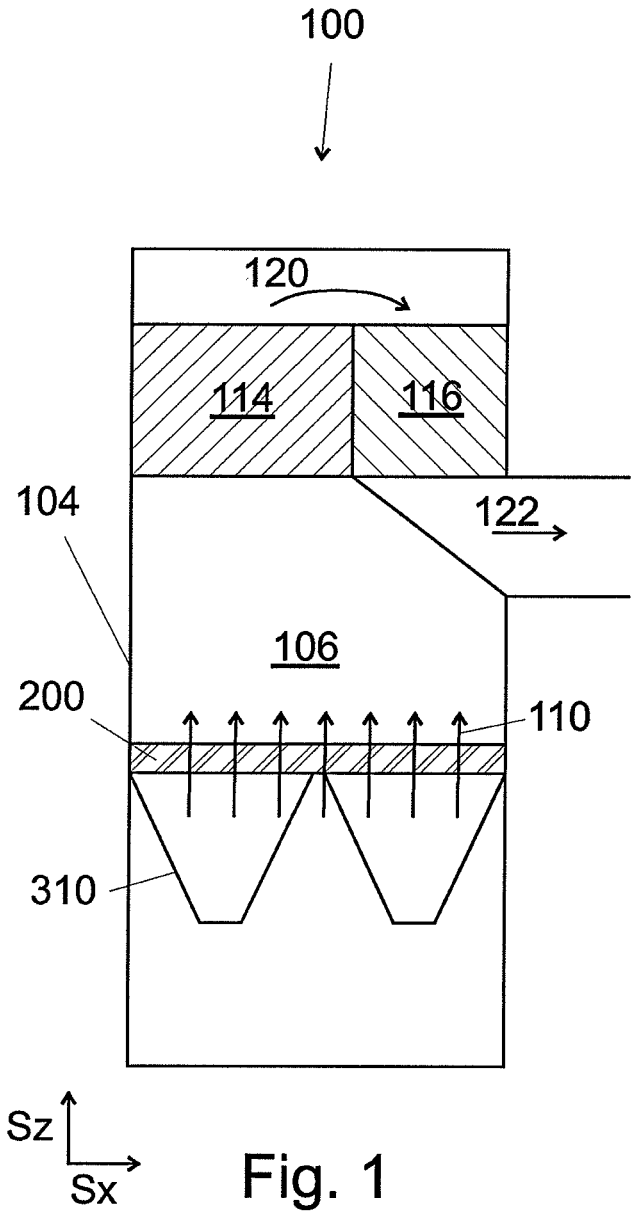
FIG. 1 shows a fluidized bed boiler in a side view.

FIG. 1 shows a fluidized bed boiler 100 of prior art in a side view. FIG. 1 shows a bubbling fluidized bed boiler (BFB boiler). A furnace 106 is limited on the sides by the walls 104 of the fluidized bed boiler. From below, the furnace is limited by a grate 200. The furnace 106 of the fluidized bed boiler contains incombustible solid bed material, such as sand. Furthermore, combustible material is supplied to the furnace 106. Air is supplied through the grate 200 to the furnace, which is shown by arrows 110. By means of the supply of air 110, at least part of the sand and the combustible material is fluidized, and the combustible material mixed in the sand is burnt. The quantity of air to be supplied to the bubbling fluidized bed boiler is relatively small, wherein the bed material is primarily fluidized at the bottom of the furnace 106, on the grate 200. Heat can be recovered from flue gases by heat exchangers 114 and 116. The flow of the flue gases is illustrated with arrows 120 and 122. In addition, heat can be recovered from the grate 200, for example in a way to be described below. The coarse material, such as ash, passing through the grate 200 can be collected in, for example, a funnel 310. From the funnel 310, the coarse material can be conveyed to further processing. Directions Sx and Sz are shown in FIG. 1. The direction Sz indicates the vertical direction. The directions Sx and Sy indicate horizontal directions. Sx, Sy and Sz are transverse to each other. In the other figures, the same references are used for the directions. As will be presented hereinbelow, either direction ±Sx refers to the longitudinal direction of an air nozzle arrangement. In a corresponding manner, either direction ±Sy refers to the cross direction (e.g. width direction) perpendicular to this direction.

Furthermore, circulating fluidized bed boilers (CFB boilers) are known. The circulating fluidized bed boilers also comprise a grate. The grate to be presented can be applied in a circulating fluidized bed boiler or a bubbling fluidized bed boiler.

Combustible material, such as wood and/or waste, is supplied to the furnace 106 of the fluidized bed boiler 100 for burning the combustible material. Along with the combustible material, such as plank wood, wood chips or municipal waste, it is possible that impurities, such as rocks and metal, such as nails, hinges and/or chains, enter the furnace 106. Some of the metal may be magnetic. Part of the magnetic metal can be separated from the combustible material before it is supplied to the furnace 106, for example by means of a magnet. Non-magnetic metal and possibly part of the magnetic metal will enter the furnace. In the furnace 106, the metal melts and is intermingled with the solids. When solids are removed from the furnace 106, they are cooled. Thus, the liquid metal solidifies. In arrangements of prior art, the solidifying metal may congeal in the air nozzles and clog them.

Figure 2A:
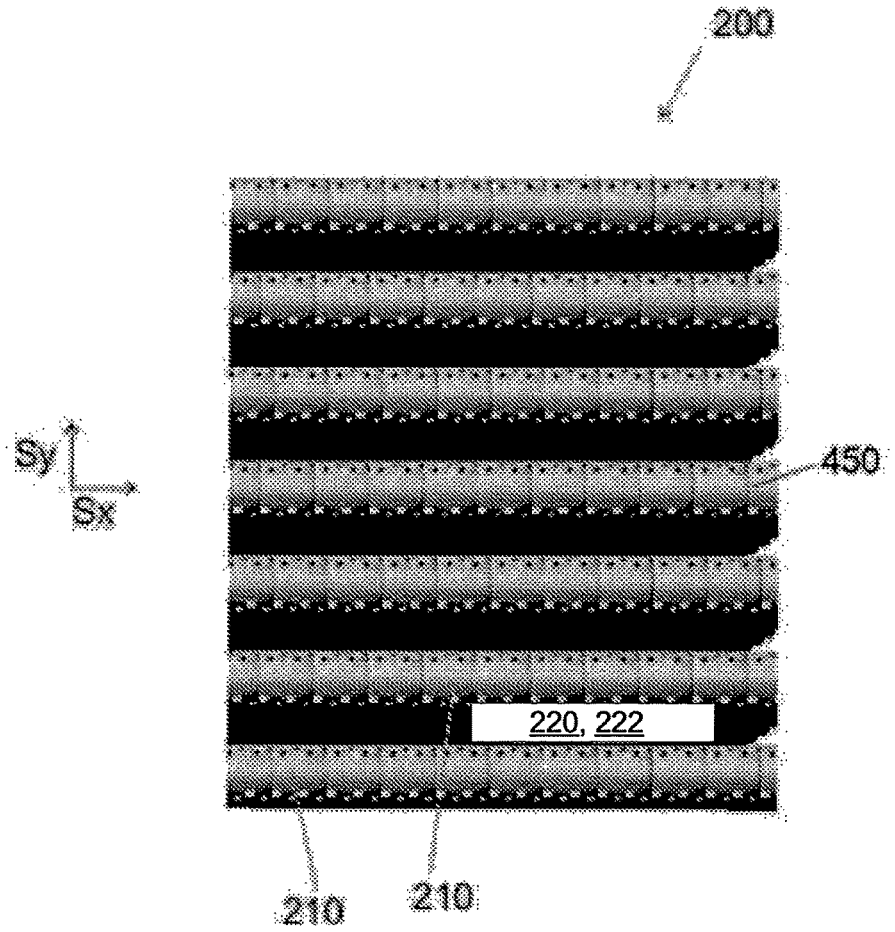
FIG. 2*a* shows part of a grate for a fluidized bed boiler in a top view.

FIG. 2a shows part of a grate 200 for a fluidized bed boiler in a top view. The grate 200 comprises grate beams 210. The grate beams 210 extend in their longitudinal direction Sx. The length L of the grate beam may be several metres, for example at least 2 m, at least 3 m, or at least 5 m. The length of the grate beam is limited by the vertical rigidity of the beam as well as the support of the beam. The grate beam may be self-bearing, wherein the grate beam is supported at its ends only, for example by a mechanical support from below, or by suspension from above. The length of the self-bearing grate beam may be, for example, 10 m at the most, 15 m at the most, or 20 m at the most. The length of the self-bearing grate beam is affected by, for example, the structure of the grate beam, which will be described in more detail later on. If the grate beam is not self-bearing, one or more supports can be provided under the grate beam, between the ends of the grate beam, to support the grate beam mechanically. The grate beam can be movably supported to said supports by means of, for example, bearings. The movability of the support and the beam with respect to each other reduces thermal stresses which might otherwise be caused by thermal expansion.

In their width direction Sy, the grate beams are spaced from each other. The width and the height of the grate beam 210 will be discussed later on. Thus, an ash removal zone 220 is left between two grate beams 210. Part of the solids (i.e. coarse material) of the fluidized bed in the fluidized bed boiler is configured to pass through said ash removal zone 220 to the space underneath the grate 200. The solids may pass, for example, substantially directly downwards, or an inclined plane can be placed underneath the grate beams; ash can be collected along said plane. In an embodiment, the bottom of the ash removal zone constitutes an inclined plane, along which the coarse material is collected (FIGS. 6*b* and 6*c*). FIG. 2*a* shows a coarse material outlet 222 which is arranged in the ash removal zone 220 and through which coarse material can be discharged downwards. The top surface of the grate beams is provided with a surface 450 to protect the air nozzles and/or air feed pipes, as will be discussed further below.

In FIG. 2*a*, the grate beams 210 are cooled. The cooled grate beams have better mechanical properties than uncooled grate beams. Thus, the grate beams are also configured to recover heat from the bed material. The grate beams can comprise, for example, a heat exchanger pipe 610 (FIG. 3*b*). Heat transfer medium, such as water, can be supplied to the heat exchanger pipes 610 via a pipe system. Heat transfer medium, such as water, can be collected from the heat exchanger pipes 610 via, for example, another pipe system.

Figure 2B:
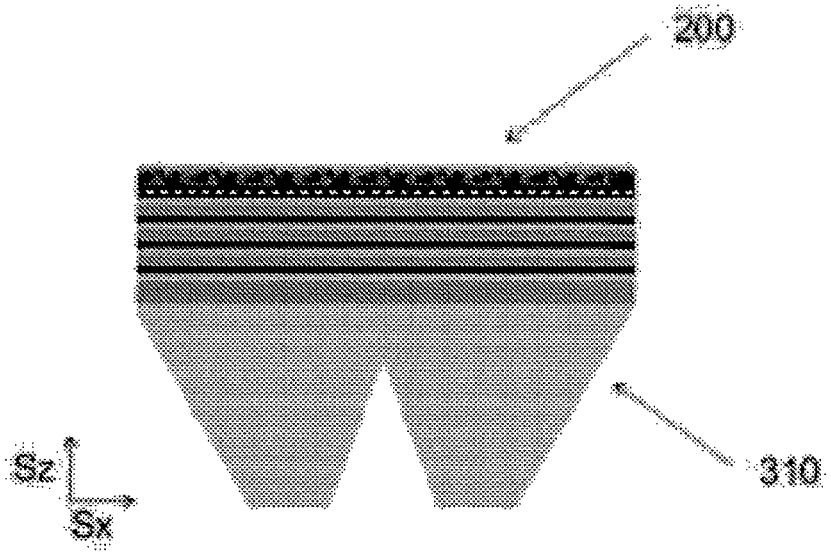
FIG. 2*b* shows a grate for a fluidized bed boiler, and parts underneath the grate, in a side view.

FIG. 2*b* illustrates a grate 200 of a fluidized bed boiler, and the parts underneath the grate 200, in a side view. Funnels 310 are provided underneath the grate 200 for collecting coarse material. For example, zero, one, at least one, two, at least two, four, at least four, six, or nine funnels 310 can be provided underneath the grate. In an advantageous embodiment, four funnels 310 are provided. The funnels 310 are upwards open, for collecting coarse material. The area formed by the top parts of the funnels 310 is substantially equal to the size of the grate 200, wherein the funnels can be used for collecting coarse material from the whole area of the grate 200.

The funnel may comprise, for example, four sheet-like planes. Said four planes may be arranged at an angle to the vertical direction, and said planes can form a funnel 310 which becomes narrower from the top downwards and has a rectangular cross section. In such a funnel, both dimensions of said rectangular cross section become narrower in the downwards direction.

As an alternative to the funnel 310 as the collector for coarse material, for example two inclined planes can be used which form a duct for collecting coarse material. Said two planes can be arranged at an angle to the vertical direction, and said planes can form a duct which becomes narrower from the top downwards and has a rectangular cross section. In such a duct, one dimension of said rectangular cross section becomes narrower in the downwards direction.

Ash can be collected underneath the duct or funnel provided for collecting ash. Furthermore, the bottom of said duct can be inclined, wherein ash can be collected at the other end of said duct. One or more heat exchanger pipes can be provided on the walls of the duct or funnel, for cooling the duct or funnel and for recovering heat from the coarse material.

Figure 3A:
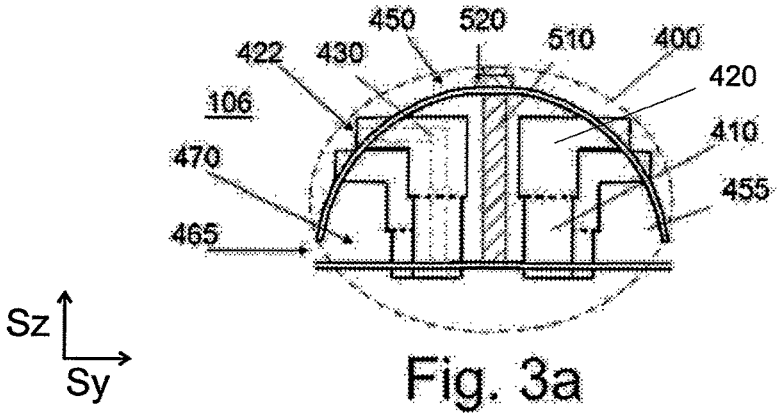
FIG. 3*a* shows an air nozzle arrangement in a view from the end of the arrangement.
Figure 3B:
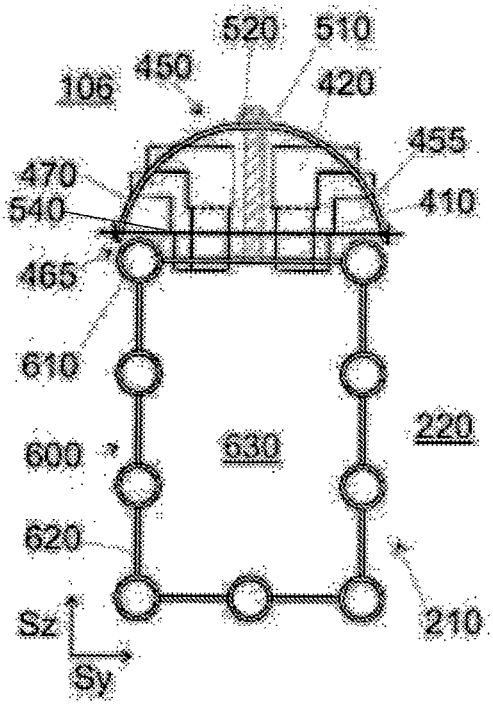
FIG. 3*b* shows an air nozzle arrangement and an air beam in a view from the end of the air beam.

FIG. 3*a* shows an air nozzle arrangement 400 for a fluidized bed boiler. FIG. 3*b* shows an air nozzle arrangement 400 according to FIG. 3*a* for a fluidized bed boiler, provided in a grate beam 210. FIG. 3*b* shows a grate beam in a cross-sectional plane which is perpendicular to the longitudinal direction Sx of the grate beam.

In FIG. 3*a*, the parts relating to the air nozzle arrangement 400 are outlined by a broken line. The air nozzle arrangement comprises an air feed pipe 410 and an air nozzle 420, which enclose an air feed duct 430. The air feed pipe 410 refers to a structure, via which air can be supplied to the fluidized bed boiler 100. The air nozzle 420 refers to a part configured to supply air to the fluidized bed boiler 100. The air nozzle 420 is connected to the air feed pipe 410. In an embodiment, the air nozzle 420 is connected to the air feed pipe 410 in such a way that the air nozzle 420 can be removed from the air feed pipe 410. In this way, the maintenance of the air nozzle arrangement is facilitated, because the air nozzles 420 can be replaced one by one, that is, without replacing other parts simultaneously. The air nozzle 420 can be an integral part of the air feed pipe 410, for example the end of the air feed pipe 410. In this case, the air nozzle 420 and the related air feed pipe 410 may be replaceable simultaneously. The air feed duct 430 is configured to supply air to the furnace 106 of the fluidized bed boiler. The air nozzle arrangement shown in FIG. 3*a* also comprises a surface 450 which is configured to guide the coarse material of the fluidized bed boiler, such as ash and/or bed material, along said surface 450. In FIG. 3*a*, the surface 450 is the top surface of the plate 455. The air nozzle arrangement 400 may be provided, for example, in the furnace 106 of the fluidized bed boiler.

Figure 3C:
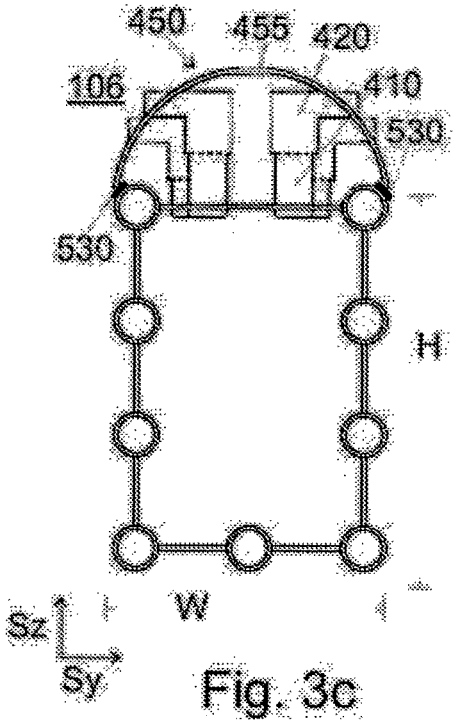
FIG. 3*c* shows an air nozzle arrangement and an air beam in a view from the end of the air beam.
Figure 3D:
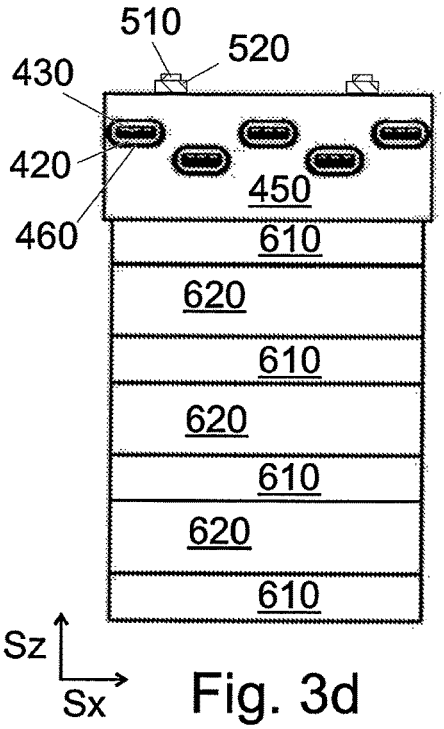
FIG. 3*d* shows the air nozzle arrangement and the air beam of FIG. 3*b* in a side view.

At least part of said surface 450 is thermally insulated from at least one of the following: the air nozzle 420 and the air feed pipe 410. At least part of said surface 450 can be thermally insulated from at least the air feed pipe 410. In FIG. 3*a*, the whole surface 450 is thermally insulated from the air feed pipe 410. Furthermore, part of the surface 450 is thermally insulated from the air nozzle 420. The surface 450 is thermally insulated in such a way that the surface 450 is spaced from the air feed pipes 410. Thus, the surface 450 has no common points with the air feed pipe 410. At the air nozzles 420, the surface 450 is provided at an angle to the surface of the air nozzles 420. Thus, only a small part of the surface 450 is arranged in contact with the air nozzle 420, whereby most of the surface 450 is thermally insulated from the air nozzles 420. Thus, heat is poorly conducted from the surface 450 to the air nozzles 420. It is also possible to provide a first gap 460 (FIG. 3*d*) between the air nozzle 420 and the surface 450, whereby the whole surface 450 is spaced from the air nozzle 420. Such a gap can be provided between each air nozzle 420 and the surface 450. In a corresponding manner, the plate 455 shown in FIG. 3*a*, comprising the surface 450, is spaced from the air feed pipes 410. In a corresponding manner, due to the first gaps 460, the plate 455 shown in FIG. 3*d* and comprising the surface 450 is also spaced from an air nozzle 420. In FIG. 3*d*, the plate 455 is spaced from all the air nozzles 420.

Furthermore, at least part of said surface 450 is configured to protect at least part of said air nozzle 420 and/or said air feed pipe 410. In particular, at least part of the surface 450 in the fluidizing bed boiler is configured to protect at least part of said air nozzle or said air feed pipe from above, because solids may flow from the top downwards in the furnace 106 of the fluidized bed boiler. Thus, at least part of the surface 450 is arranged at least partly above at least some air nozzle 420 or air feed pipe 410. Moreover, the air nozzle 420 is thus provided in the furnace 106 of the fluidized bed boiler 100.

Figure 3E:
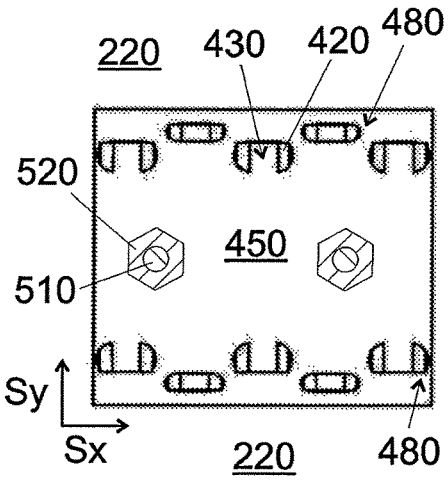
FIG. 3*e* shows the air nozzle arrangement and the air beam of FIG. 3*b* in a top view.

As shown in FIGS. 3*a* to 3*e*, in one embodiment, the surface 450 delimits openings 480 (FIG. 3*e*). In FIGS. 3*a* to 3*e*, part of the air nozzle 420 is arranged in the opening 480 of the surface 450. Thus, the air duct 430 is also arranged in said opening. In the air nozzle arrangement shown in FIGS. 3*a* to 3*e*, the air nozzle 420 is arranged to feed air to the fluidized bed boiler via the opening 480 in the surface 450. In FIGS. 3*a* to 3*e*, said surface 450 is the top surface of the plate 455. In a corresponding manner, the plate 455 comprises the opening or hole 480. In a corresponding manner, the air nozzle 420 is configured to supply air to the fluidized bed boiler via the opening 480 in the plate 455.

The above presented, at least partly thermally insulated surface 450 thus protects at least part of said air nozzle 420 or of said air feed pipe 410 from solids coming from above. The solids can comprise, for example, liquid metal. In particular, the solids can comprise, for example, molten non-magnetic metal, because magnetic metals can be extracted from the fuel by means of magnets.

Because at least part of the surface 450 is thermally insulated from the air feed pipe 410 and/or the air nozzle 420, the surface 450 remains substantially hot in the furnace of the fluidized bed boiler. In particular, when the boiler is in operation, the temperature of the surface 450 is higher than the temperature of the air nozzles 420. Thus, the liquid metal carried along with the solids of the furnace does not solidify when it hits the surface 450, and the solids are guided downwards along the surface 450 (downwards and also to the side, according to the shape of the surface 450). The solids can be guided towards points of collecting coarse material, for example the ash removal zone 220. Particularly by means of the surface 450, the solidification of molten material in the air nozzle arrangement 400 is reduced. In the above described way, particularly the solidification of liquid non-magnetic metals in the air nozzle arrangement 400 is reduced.

For intensifying the guiding, at least part of the surface 450 can be arranged at an angle to the horizontal plane. The angle of the surface to the horizontal plane refers to the angle between the normal of the tangent plane of the surface and the normal (i.e. the vertical direction) of the horizontal plane (horizontal surface), seen at a point of the surface. For example, at least part of the surface 450 can be arranged at an angle of at least 4 degrees, at least 10 degrees or at least 20 degrees to the horizontal plane. With reference to FIGS. 3 to 4, in some embodiments, at least 50% of the surface 450 is arranged at an angle of at least 10 degrees to the horizontal plane.

When heat is recovered from ash, the ash cools down and the liquid material solidifies. However, in the presented fluidized bed boiler this takes place first underneath the air nozzle arrangement, whereby the solidifying material does not stick to the air nozzles 420. Thus, the need for maintenance of the fluidized bed boiler is reduced. The solidification of coarse material in the air nozzles can be further reduced by applying air nozzles with a large nozzle orifice 422 (FIG. 3*a*). The cross-section of the nozzle orifice 422 of the air nozzle 420 can have the shape of, for example, a rectangle with rounded corners, a circle, or an ellipse. The nozzle orifice of the air nozzle is large when the area of the nozzle orifice is at least 50% of the cross-sectional area of the air nozzle 420. More advantageously, the area of the nozzle orifice is at least 75% of the cross-sectional area of the air nozzle 420. In an embodiment, the air nozzle 420 comprises only one nozzle orifice 422. Such a nozzle orifice 422 is less susceptible to clogging than an air nozzle comprising several smaller nozzle orifices 422.

The temperature of the air to be introduced in the furnace of the fluidized bed boiler can be, for example, 100° C. to 300° C. Thus, the temperature of the air feed pipe 410 can be about 100° C. to 300° C. The temperature of the furnace can be significantly higher, for example 600° C. to 900° C. Because of the air to be supplied, the temperature at the bottom of the furnace, close to the air supply, is lower than at a higher location. The temperature of the surface 450 can be, for example, 300° C. to 800° C.

When at least part of the protective surface 450 is thermally insulated from the air feed pipe 410 and/or the air nozzle 420, the temperature of the air nozzles 420 and/or the air feed pipe 410 during the operation of the fluidized bed boiler is lower than in a case with no protective surface 450. This is due not only to the thermal insulation but also to the fact that the supplied air is colder than the conditions in the furnace of the fluidized bed. At a lower operating temperature, the air nozzles 420 and/or the air feed pipe 410 and thereby the air nozzle arrangement 400 are more durable than at a higher temperature.

FIG. 3*a* shows a plate 455 comprising a surface 450. Such a plate can be replaced alone, for example during maintenance operations. In this context, the term "alone" refers to the replaceability of the plate 455 without simultaneously replacing other components, such as the air nozzles 420. The plate 455 shown in FIG. 3*a* can be arranged as part of a larger integral structure. In an air nozzle arrangement, the plate 455 and the air nozzles 420 constitute an integral structure. Such a structure can be replaceable as a unit during the maintenance of the boiler 100, whereby both the plate 455 and the air nozzles 420 can be replaced simultaneously. In an air nozzle arrangement, the plate 455, the air nozzles 420 and the air feed pipes 410 constitute an integral structure. Such a structure can be replaceable as a unit during the maintenance of the boiler 100, whereby the plate 455, the air nozzles 420, as well as the air feed pipes 410 can be replaced simultaneously.

The plate 455 can be connected to the air nozzle arrangement by fastening members, such as a threaded bar 510 and a bolt 520 (FIGS. 3*a* and 3*b*). Thus, the structure may be open below. For example, a second gap 465 can be left between the plate 455 and the structure underneath. The second gap 465 thermally insulates the plate 455 from the rest of the structure, including the upper surface of the air plenum chamber underneath. The top surface of the structure underneath can comprise, for example, a heat exchanger pipe 610 and/or an air beam 600 (FIG. 3*b*). The plate 455 can be connected to the air nozzle arrangement by fastening members, such as an intermediate spacer 530 (FIG. 3*c*). Such an intermediate spacer 530 can extend in the longitudinal direction Sx of the structure, for example a short distance only, whereby the structure is open below in other parts. A corresponding second gap 465 can be left in these other parts, as shown in FIG. 3*b*. The second gap thermally insulates the plate 455 from the rest of the structure, such as the heat exchanger pipe 610 or the air beam 600, also in the embodiment of FIG. 3*c*.

Via the second gap 465, the space 470 between the surface 450 and the air feed pipes 410 or the air nozzles 420 can be filled or at least partly filled with coarse material of the fluidized bed boiler. Such coarse material can act as thermal insulation between the surface 450 and the air feed pipes 410 or the air nozzles 420. In a corresponding manner, the space 470 itself can act as thermal insulation between the surface 450 and the air feed pipes 410 or the air nozzles 420.

The plate 455 is advantageously made of a very heat resistant material. The service life of the plate can be further improved with a reinforcement 540. The reinforcement 540 can comprise, for example, a threaded bar and at least one nut. The plate 455 is advantageously made of a very wear resistant material. The plate can comprise metal. The plate can comprise steel. The plate can comprise stainless steel. The plate can comprise austenitic stainless steel. Such stainless steel comprises iron, nickel, and chromium. Stainless steel is also advantageous in respect that the thermal conductivity of stainless steel is lower than that of many other metals. For example, the thermal conductivity of the metal plate 455 (FIGS. 3*a* to 3*e*) can be at least 15 W/mK, depending on the metal. The thermal conductivity of stainless steel is typically relatively poor for a metal, for example about 16 W/mK at room temperature. For some other steels, the thermal conductivity at room temperature is about 40 W/mK, for cast iron about 50 W/mK, and for aluminium about 250 W/mK. The thermal conductivity is dependent on the temperature, but even at a higher temperature, such as in a fluidized bed boiler, the thermal conductivity of stainless steel is lower than that of some other metals. Advantageously, the thermal conductivity of the plate 455 at room temperature is not higher than 25 W/mK.

As shown in FIGS. 3*a* to 3*e*, an air nozzle arrangement 400 for a fluidized bed boiler comprises several air nozzles 420. In an embodiment, said surface 450 is configured to protect at least two air nozzles. In an embodiment, the plate 455 comprising the surface 450 is configured to protect at least two air nozzles. One plate 455 can be arranged to protect all the air nozzles of the air nozzle arrangement. The air nozzle arrangement can comprise several plates 455. Furthermore, the air nozzle arrangement can be arranged as a part of the grate beam 210 (FIGS. 2*a* and 3*b* to 3*e*).

With reference to the FIGS. 3*a*, 3*b*, 3*d*, and 3*e*, an air nozzle arrangement comprises several air nozzles spaced from each other in the longitudinal direction Sx of the air nozzle arrangement. In the presented arrangement, at least one air nozzle 420 is configured to supply air to the furnace 106 of the fluidized bed boiler in a direction which forms an angle not greater than 80 degrees to the horizontal plane and forms an angle of at least 10 degrees with the longitudinal direction Sx. In FIGS. 3 (particularly 3*b*), said direction is substantially horizontal, wherein said direction does not form an angle to the horizontal plane, or such an angle is zero. In FIGS. 3 (particularly 3*e*), said direction forms an angle of about 90 degrees with the longitudinal direction Sx. Advantageously, the air nozzle 420 is configured to supply air to the furnace 106 of the fluidized bed boiler in a direction which forms an angle not greater than 60 degrees, not greater than 45 degrees, or not greater than 30 degrees, to the horizontal plane. Advantageously, in addition or alternatively, the air nozzle 420 is configured to supply air to the furnace 106 of the fluidized bed boiler in a direction which forms an angle of at least 30 degrees, at least 45 degrees, or at least 60 degrees, to the longitudinal direction Sx. When the direction of the air nozzle 420 is arranged in this way, the air nozzle 420 is configured to supply air to the furnace 106 in such a way that the air guides the coarse material towards the ash removal zone 220 or the coarse material outlet 222. By adjusting the direction, particularly the direction of the air nozzle in the longitudinal direction Sx, it is also possible to guide the coarse material towards either end of the ash removal zone in the longitudinal direction. For example in FIG. 3*e*, by turning the air nozzles in this way, solids could also be guided slightly to the right or to the left in addition to guiding the solids towards the ash removal zone 220 or zones 220. The direction is illustrated with the reference numeral 810 in FIG. 6*c*.

With reference to FIGS. 2*a*, 3*b* to 3*e*, and 5, the air nozzle arrangement 400 can be arranged as part of the grate beam 210. Such a grate beam 210 comprises the air nozzle arrangement 400 of a fluidized bed boiler. Furthermore, the grate beam 210 comprises an air beam 600 (FIG. 3*b*). The air beam 600 is configured to supply air to at least said air feed duct 430 (see FIG. 3*a*), for example to the air feed pipe 410. The air beam 600 comprises walls 620 which delimit the space for supplying air. The walls 620 enclose a space 630, from which air can be supplied to the air feed duct 430. In FIG. 3*b*, the air beam comprises at least one (exactly nine) heat exchanger pipe(s) 610. The heat exchanger pipe 610 is configured in such a way that at least one wall 620 comprises at least one heat exchanger pipe 610. The heat exchanger pipe 610 is arranged in or on said wall 620; in other words, the heat exchanger pipe 610 can be in the wall (inside it) or on the wall (on the surface of the wall), for example on the outer or inner surface of the wall 620 with respect to the space 630.

The heat exchanger pipe 610 provides the advantage that the grate beam 210 can be cooled by the heat exchanger pipe. Thus, when the fluidized bed boiler 100 is in operation, the temperature of the cooled grate beam 210 is lower than the temperature of an uncooled grate beam would be. The mechanical properties of the material of the grate beam 210 are typically better at a lower temperature than at a high temperature. Such properties include high strength, low creep, lower thermal expansion, and low wear. Consequently, the service life of the cooled grate beam is longer than the service life of an uncooled grate beam. Lower thermal expansion reduces thermal stresses, which increases the service life further. Furthermore, the temperature increase of the cooled grate beam is in the same order as that of the cooled walls 104 of the fluidized bed boiler 100 (FIG. 1). This will reduce the thermal stresses of the structure further.

When the fluidized bed boiler is in operation, at least one of the walls 620 is arranged in contact with coarse material. Thus, the heat exchanger pipe 610 is configured to recover heat from the coarse material. In addition, this gives the advantage that heat can be recovered from the coarse material to be removed from the furnace 106, whereby the efficiency of the boiler is improved.

With reference to FIGS. 3*b* and 3*c*, in one embodiment of the grate beam, at least part of said surface 450 is thermally insulated from said heat exchanger pipe 610. Thus, the temperature of said surface 450 is arranged high, in spite of the heat exchanger pipe 610.

The dimensions of the grate beam 210 influence the load bearing capacity of the beam. For example, the grate beam 210 of the fluidized bed boiler shown in FIGS. 3*b*, 3*d* and 3*e* comprises an air beam 600. The air beam 600 has a profile form extending in its longitudinal direction Sx. The air nozzles 420 of the air nozzle arrangement of the fluidized bed boiler are arranged on the first side of (in the figures, above) said air beam 600, the first side defining the height direction of the air beam, the height direction extending from the second side of the air beam, opposite to the first side, to the first side of the air beam 600 (in the figures, upwards). The air beam 600 has a height H in said height direction (Sz). Furthermore, the air beam 600 has a width W in a direction (Sy) perpendicular to said height direction and perpendicular to said longitudinal direction.

In an embodiment, the height of the air beam 600 is greater than the width. Thus, the load bearing capacity of the grate beam 210 in the height direction is good, whereby the length of the grate beam can be arranged great without providing separate supporting structures. Furthermore, the contact surface of the wall 620 of the air beam 600, such as the wall in said height direction, with the bed material is large, whereby heat can be effectively recovered from the bed material. Corresponding dimensioning applies to the grate beam 210 itself as well. In an embodiment, the height of the grate beam 210 is greater than the width.

The grate beam 210, too, has a profile form extending in its longitudinal direction Sx. The air nozzles 420 of the air nozzle arrangement of the fluidized bed boiler are arranged on the first side of (in the figures, above) said grate beam 210, the first side defining the height direction of the grate beam, the height direction extending from the second side of the grate beam, opposite to the first side, to the first side of the grate beam 210 (in the figures, upwards). The grate beam 210 has a height in said height direction (Sz). Furthermore, the grate beam 210 has a width in a direction (Sy) perpendicular to said height direction and perpendicular to said longitudinal direction.

FIGS. 3*b*, 3*c* and 3*d* show an air beam 600 with four heat exchanger pipes 610 on its upright walls 620. Depending on the height of the air beam 600, the number of heat exchanger pipes 610 on the upright walls 620 can be, for example, zero, one, at least one, two, at least two, three, at least three, four, at least four, five, at least five, six, or more. Advantageously, the upright wall 620 of the air beam 600 comprises at least one heat exchanger pipe. FIGS. 3*b*, 3*c* and 3*d* show an air beam 600 with one heat exchanger pipe 610 on its horizontal wall (that is, on the bottom surface of the air beam). The number of heat exchanger pipes 610 on the horizontal walls 620 can also vary in different embodiments.

Referring to FIGS. 3, in some arrangements 400, the surface 450 is further configured to protect the air beam 600. Furthermore, at least part of the surface 450 is thermally insulated from the air beam 600. In FIG. 3*b*, the whole surface 450 is thermally insulated from the air beam 600. In FIG. 3*b*, the whole plate 455 is thermally insulated from the air beam 600. The size of the surface 450 with respect to the air beam 600 can be configured such that the surface 450 protects the whole air beam 600 from above (FIGS. 3*e* and 4*a*) or at least nearly the whole air beam (FIGS. 41 and 4*c*1). In other words, the area of the horizontal cross-section of the surface 450 is at least 80% or at least 90% of the area of the horizontal cross-section of the air beam 600.

The size of the surface 450 with respect to the grate beam 210 can be configured such that the surface 450 protects the rest of the whole grate beam 210 from above (FIG. 3*e*) or at least nearly the rest of the whole grate beam (FIGS. 4*a*, 4*b*1 and 4*c*1). In an embodiment, the area of the horizontal cross-section of the surface 450 is greater than the area of the horizontal cross-section of the air beam 600. Even in these cases, the area of the horizontal cross-section of the surface 450 is at least 80% or at least 90% of the area of the horizontal cross-section of the air beam 600.

In yet some other embodiments, the surface 450 is thermally insulated from the heat exchanger pipes 610. For example, no heat exchanger pipe 610 is provided in or on the surface 450. Thus, the surface 450 is uncooled. In a corresponding manner, no heat exchanger pipe 610 is provided in or on the plate 455. Thus, the plate 455 is uncooled.

Referring to FIGS. 2*a* and 2*b*, the fluidized bed boiler 100 can comprise a grate 200 for the fluidized bed boiler. Such a grate 200 for a fluidized bed boiler can comprise, for example,

- an air nozzle arrangement 400 according to any of the presented types for a fluidized bed boiler, or
- a grate beam 210 according to any of the presented types for a fluidized bed boiler. In particular, the presented grate beam 210 comprises an air nozzle arrangement 400 according to any of the presented types for a fluidized boiler.

Referring to FIG. 1, the fluidized bed boiler 100 can comprise, for example,

- a grate 200 of the above presented type for a fluidized bed boiler,
- an air nozzle arrangement 400 according to any of the presented types for a fluidized bed boiler, or
- a grate beam 210 according to any of the presented types for a fluidized bed boiler.

FIGS. 4*a* to 4*c*3 show some air nozzle arrangements 400 for a fluidized bed boiler 100. In the figures, the air nozzle arrangements are provided in the grate beam 210, but air nozzle arrangements of a corresponding type can also be used separately from the grate beam and the air beam.

FIG. 4*a* shows an air nozzle arrangement for a fluidized bed boiler in an end view. The air nozzle arrangement further comprises a surface 450 configured to guide solids of the fluidized bed boiler along said surface 450. The air nozzle arrangement comprises a plate 455 comprising the surface 450. The air nozzle arrangement 400 further comprises air feed pipes 410 and air nozzles 420. At least part of said surface 450 is thermally insulated from at least one of the following: the air nozzle 420 and the air feed pipe 410. At the air feed pipes 410, the surface 450 is provided at an angle to the surface of the air feed pipes 410. Thus, heat is poorly conducted from the surface 450 to the air feed pipes 410. Furthermore, at least part of said surface 450 is configured to protect at least part of said air nozzle and/or said air feed pipe, particularly the air feed pipe 410 in FIG. 4*a*. In FIG. 4*a*, the air nozzles 420 comprise openings at their sides, for introducing air into the furnace. Thus, the air nozzles 420 are configured to introduce air into the fluidized bed boiler in a direction that is substantially horizontal. Consequently, the air nozzles 420 are also configured to supply air to the fluidized bed boiler in a direction towards the ash removal zone 220 or the coarse material outlet 222.

FIGS. 4*b*1 to 4*b*3 show an air nozzle arrangement 400 for a fluidized bed boiler. FIG. 4*b*1 shows the air nozzle arrangement 400 in an end view. FIG. 4*b*2 shows the air nozzle arrangement 400 in a side view. FIG. 4*b*3 shows the air nozzle arrangement 400 in a perspective view.

The air nozzle arrangement of FIGS. 4*b*1 to 4*b*3 comprises a surface 450 configured to guide solids of the fluidized bed boiler along said surface 450. In FIGS. 4*b*, the surface 450 is the surface 450 of a brick laid structure. The surface 450 is the surface of a brick 456. Furthermore, the air nozzle arrangement 400 comprises other supports 457, such as bricks, to which said bricks 456 are joined, for example by laying (FIG. 4*b*3). The air nozzle arrangement 400 comprises first air nozzles 420a and second air nozzles 420b. The air nozzle arrangement can also comprise air feed pipes 410. Said surface 450 is thermally insulated from the air nozzles 420. The thermal insulation is provided, for example, by selecting the material of the surface 450 such that the material of the surface 450 conducts heat poorly. The material conducts heat poorly if its heat conductivity at room temperature is not greater than 25 W/mK. A material conducts heat poorly if its heat conductivity at room temperature is not greater than 10 W/mK, or not greater than 5 W/mK. For example, brick or stone conducts heat poorly. The heat conductivity of brick can be, for example, between 0.5 W/mK and 2 W/mK; for example, the heat conductivity of fire brick is about 1.7 W/mK. As described above, stainless steel also conducts heat relatively poorly.

Said surface 450 is configured to protect the air nozzles 420*a* and 420*b*. The first air nozzles 420*a* are configured to supply air in a direction which is substantially horizontal and towards the ash removal zone 220. In the case of the figure, the first air nozzles 420*a* are configured to supply air in a direction which is perpendicular to the longitudinal direction Sx of the air nozzle arrangement 400 and the height direction Sz. The second air nozzles 420*b* are configured to supply air in a direction which is substantially horizontal and extends in the longitudinal direction of the air nozzle arrangement.

FIGS. 4*c*1 to 4*c*3 show an air nozzle arrangement 400 for a fluidized bed boiler. FIG. 4*c*1 shows the air nozzle arrangement 400 in an end view. FIG. 4*c*2 shows the air nozzle arrangement 400 in a side view. FIG. 4*c*3 shows the air nozzle arrangement 400 in a top view.

The air nozzle arrangement of FIGS. 4*c*1 to 4*c*3 comprises a surface 450 configured to guide solids of the fluidized bed boiler along said surface 450. The surface 450 can be, for example, the surface 450 of a solid brick-laid structure 458 (FIG. 4*c*1). The air nozzle arrangement 400 comprises first air nozzles 420*a* and second air nozzles 420*b*. The air nozzle arrangement also comprises air feed pipes 410. Said surface 450 is thermally insulated from the air nozzles 420. The thermal insulation is provided, for example, by selecting the material of the brick-laid structure 458 such that the material of the surface 450 conducts heat poorly. The heat conductivity of some advantageous materials has been discussed above.

Said surface 450 is configured to protect the air feed pipes 410. The first air nozzles 420*a* are configured to supply air in a direction which is substantially horizontal and extends towards the ash removal zone. In the case of the figure, the first air nozzles 420*a* are configured to supply air in a direction which is perpendicular to the longitudinal direction Sx of the air nozzle arrangement 400 and the height direction Sz, that is, in a direction towards the ash removal zone 220. The second air nozzles 420*b* are configured to supply air in a direction which is substantially horizontal. The second air nozzles 420*b*, too, are also configured to supply air in a direction towards the ash removal zone 220.

Figure 5:
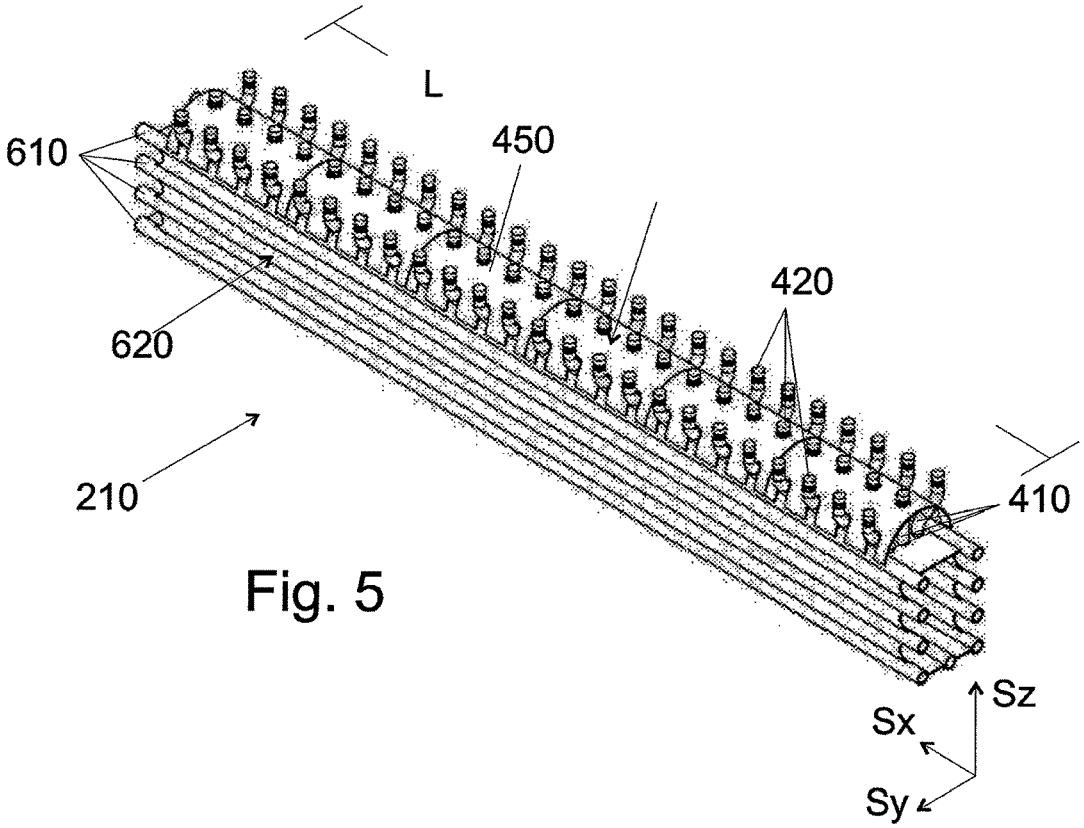
FIG. 5 shows a perspective view of a grate beam comprising the nozzle arrangement of FIG. 4*a*.

FIG. 5 shows a perspective view of a grate beam 210 comprising a nozzle arrangement according to FIG. 4*a*. The length of the grate beam 210 is indicated with the letter L. The length of the grate beam was discussed above. The grate 200 of the fluidized bed boiler can comprise, for example, grate beams 210 of the type shown in FIG. 5. The grate beam 210 can be connected to a heat transfer medium circulation by means of heat exchanger pipes 610. The grate beam 210 can be connected to the heat transfer medium circulation of the fluidized bed boiler 100 by means of heat exchanger pipes 610. The heat transfer medium to be circulated in the heat exchanger pipes can comprise, for example, at least one of the following: water and steam.

Figure 6A:
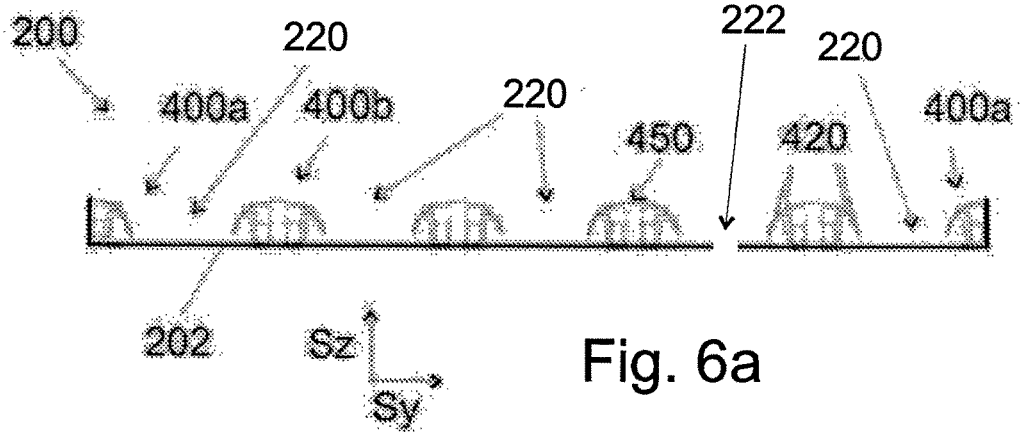
FIG. 6*a* shows a grate for a fluidized bed boiler in an end view.
Figure 6B:
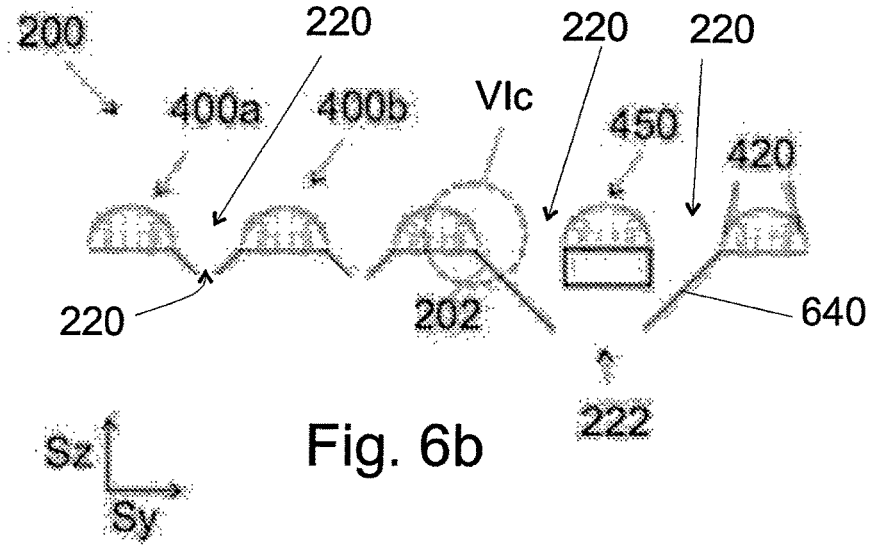
FIG. 6*b* shows a grate for a fluidized bed boiler in an end view.
Figure 6C:
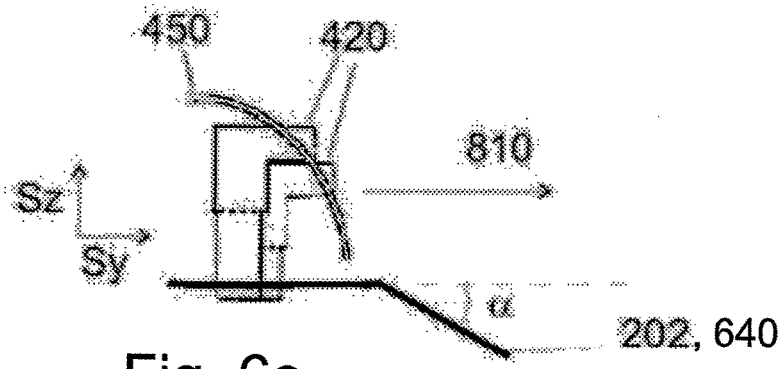
FIG. 6*c* shows part VIc of FIG. 6 in more detail.

FIG. 6*a* shows a grate 200 for a fluidized bed boiler in an end view. The grate in the figure comprises several air nozzle arrangements 400*a* and 400*b* for a fluidized bed boiler. As shown in the figure, the grate comprises first air nozzle arrangements 400*a* and second air nozzle arrangements 400*b*. The first air nozzle arrangements 400*a* are provided at two opposite edges of the grate 200. The second air nozzle arrangements 400*b* are provided between the first air nozzle arrangements 400*a*, that is, in the middle section of the grate. In the first air nozzle arrangements 400*a*, the air nozzles 420 are configured to direct an air flow in substantially one direction towards the ash removal zones 220. In the second air nozzle arrangements 400*b*, the air nozzles 420 are configured to direct an air flow in substantially two opposite directions towards the ash removal zones 220, that is, towards two adjacent ash removal zones 220. The ash removal zone 220 refers to the zones from which coarse material, such as ash, combustible material and bed material, can be collected from the fluidized bed boiler.

The grate 200 of FIG. 6*a* comprises a flat bottom 202. The air nozzle arrangements 400 are provided slightly elevated above the bottom 202 of the grate. The bottom 202 can comprise coarse material outlets 222, for example in an ash removal zone 220. The bottom 202 does not necessarily comprise coarse material outlets 222. The bottom 202 can be, for example, inclined, in which case coarse material is guided to the ash removal zones 220. The coarse material can flow along the ash removal zone 220 to be discharged from the boiler. In the grate assembly, coarse material outlets 222 can be provided at the lowermost edge of the grate 200 in the fluidized bed boiler. Thus, the coarse material is also moved by gravity towards the coarse material outlets 222 in the ash removal zone 220. The bottom 202 of the grate 200 can comprise heat exchanger pipes for recovering heat from the coarse material.

In FIG. 6*a*, the coarse material (such as ash) may be left on the bottom 202 of the grate 200, if the removal of coarse material is not sufficiently efficient. Thus, coarse material may accumulate in front of the air nozzles 420. With regard to the removal of coarse material, the coarse material outlets 222 described with reference to FIGS. 2*a* and 3*b* are advantageous. The inclined planes shown in FIGS. 6*b* and 6*c* are also advantageous. Consequently, at least one air nozzle 420 of the air nozzle arrangement 400 is preferably configured to supply air to the furnace of the fluidized bed boiler in such a way that

- the air nozzle 420 is spaced by at least a distance from the surfaces of the fluidized bed boiler, such as the surface of the grate, excluding said protecting surface 450. Said distance can be, for example, at least 10 cm or at least 20 cm. For example in FIGS. 3, 4 and 5, the air nozzle 420 is configured in this way. OR
- the air nozzle 420 is configured closer than said distance to a surface of the fluidized bed boiler, for example to the bottom 202 of the grate 200, and the air flow formed by the air nozzle 420 is directed away from said surface and forms an angle to said surface. The angle can be, for example, at least 15 degrees. For example in FIGS. 6*b* and 6*c*, the air flow is substantially horizontal and the air nozzle 420 is configured closer than said distance to the bottom 202 of the grate 200. However, the bottom 202 of the grate forms an angle to the horizontal plane, said angle being at least 15 degrees.

If either of the above described conditions is met, the air nozzle 420 is configured to direct an air flow to the freely fluidized or flowing coarse material. For example in FIGS. 3, 4 and 5, the air nozzle is configured to direct an air flow to freely fluidized coarse material. For example in FIGS. 6*b* and 6*c*, the air nozzle is configured to direct an air flow to freely flowing coarse material (flowing along the bottom 202 of the grate).

The above mentioned angle is illustrated in more detail in FIGS. 6*b* and 6*c*. FIG. 6*b* shows a grate 200 for a fluidized bed boiler in an end view. The bottom 202 of the grate 200 is not flat but it is arranged at an angle to the horizontal plane in the vicinity of the coarse material outlets 222. FIG. 6*c* shows the section VIc of FIG. 6*b* in more detail. In FIG. 6*c*, the air nozzle 420 is provided relatively close to the bottom 202 of the grate 200 of the fluidized bed boiler (i.e. a surface of the fluidized bed boiler). The direction of the air flow generated by the air nozzle 420, illustrated by an arrow 810, is away from said surface 202 and forms an angle α to said surface. The angle α is greater than 15 degrees. If said one surface of the fluidized bed boiler is curved, the angle can be formed between the tangent plane of the surface and the direction of the air flow. In the arrangements according to FIGS. 6*b* and 6*c*, the bottom 202 of the grate can also comprise heat exchanger pipes for recovering heat. It should be noted that if the angle α is increased, the grate 200 is substantially similar to that shown in FIGS. 2*a* and 3*b*, when the angle α is straight. In a corresponding manner, when the angle is zero, the grate 200 is substantially similar to that shown in FIG. 6*a*.

Referring to FIGS. 2*a*, 6*a* and 6*b*, a grate 200 for a fluidized bed boiler 100 comprises

- a first air nozzle arrangement 400 a with several air nozzles 420 spaced from each other in the longitudinal direction of the first air nozzle arrangement 400*a*, and
- a second air nozzle arrangement 400*b* with several air nozzles 420 spaced from each other in the longitudinal direction of the second air nozzle arrangement 400*b*, in which grate 200
- the second air nozzle arrangement 400*b* is spaced from the first air nozzle arrangement 400*a* in a cross direction transverse to the longitudinal direction, wherein
- an ash removal zone 220 and/or a coarse material outlet 222 is left between the first and second air nozzle arrangements (400*a*, 400*b*).

Referring to FIG. 2*a*, the longitudinal direction of the first air nozzle arrangement is, in an embodiment, parallel to the longitudinal direction of the second air nozzle arrangement.

Referring to, for example, FIGS. 2*a* and 3*b*, in an embodiment, an ash removal zone 220 is left between the first and second air nozzle arrangements (400*a*, 400*b*). The ash removal zone 220 can comprise a coarse material outlet 222. The coarse material outlet 222 is limited by walls, such as walls 620 (FIG. 3*b*). In an embodiment shown in FIG. 3*b*, the walls are substantially vertical. One direction of the substantially vertical wall forms a maximum angle of 5 degrees to the vertical direction. One direction of a completely upright wall is vertical. If the walls are vertical or substantially vertical, the coarse material outlet 222 can be used as the ash removal zone 220.

Referring to FIGS. 6*b* and 6*c*, in an embodiment, an ash removal zone 220 is left between the first and second air nozzle arrangements (400*a*, 400*b*). The ash removal zone 220 is limited by walls, such as walls 640 (FIG. 6*b*). The bottom 202 of the grate (FIG. 6*c*) can also be considered such a wall 640. In an embodiment shown in FIG. 6*b*, the walls 640 are configured at an angle, for example the angle α, to the horizontal plane (FIG. 6*c*). Advantageously, the angle is sufficiently large for moving coarse material along the wall 640 by gravity. Advantageously, one direction of the wall 640 forms an angle of at least 5 degrees to the horizontal direction. More advantageously, one direction of the wall 640 forms an angle of at least 15 degrees, at least 30 degrees or at least 45 degrees to the horizontal direction.

The fluidized bed boiler can comprise said grate beam 210. The presented grate beams can comprise an air beam 600. The air beams 600 have a profile form extending in the longitudinal direction. The air nozzles 420 in the grate beams are arranged on the first side of said air beam, the first side defining the height direction of the air beam, the height direction extending from the second side of the air beam, opposite to the first side, to the first side of the air beam. This height direction defines the width direction, which width direction is perpendicular to said height direction and perpendicular to said longitudinal direction of the air beam. In the grate 200 of the fluidized bed boiler, the grate beams 210 are spaced from each other in said width direction. Thus, an ash removal zone 220 is left between two grate beams 210. Via the ash removal zone 220, coarse material, such as ash and bed material, can be removed from the fluidized bed boiler 100. The ash removal zone 220 can comprise a coarse material outlet 222. Via the coarse material outlet 222, coarse material, such as ash and bed material, can be removed from the fluidized bed boiler 100. The fluidized bed boiler also comprises a duct or a funnel 310 for collecting coarse material. In the fluidized bed boiler, at least part of the coarse material in the fluidized bed is configured to flow along said surface 450 of the air nozzle arrangement 400 of the fluidized bed boiler, via said ash removal zone 220 to said duct or funnel 310 for collecting ash. In such a fluidized bed boiler, at least part of at least one of said air nozzle 420 or said air feed pipe 410 is protected by said surface 450. At least part of the surface 450 is thermally insulated from the air nozzle 420 or the air feed pipe 410, whereby solidification of molten solids on said surface is reduced. In addition, the heat exchanger pipe 610 of the grate beam 210 is configured to recover heat from the coarse material passing through said ash removal zone 220, whereby the efficiency of the fluidized bed boiler is good and the mechanical properties of the grate beam 210 remain good, as presented above.

During the operation of the fluidized bed boiler, coarse material is removed from the fluidized bed boiler. As presented above, the fluidized bed boiler comprises an air nozzle 420 and an air feed pipe 410. In the combustion process, air is supplied by the air nozzle 420 to the furnace 106 of the fluidized bed boiler. Coarse material is removed from the furnace 106 of the fluidized bed boiler via the ash removal zone 220 of the grate 200 or the coarse material outlet 222 of the fluidized bed boiler. Coarse material is removed from the furnace by

- guiding at least part of the coarse material along the surface 450 towards said ash removal zone 220 or coarse material outlet 222, at least part of the surface being thermally insulated from at least one of the following: the air nozzle 420 and the air feed pipe 410, and
- protecting at least part of the air nozzle 420 and/or the air feed pipe 410 by means of said surface 450.

Furthermore, air can be supplied by the air nozzle 420 to the furnace 106 of the fluidized bed boiler in a direction towards said ash removal zone 220 or coarse material outlet 222.

The invention claimed is:

1. A fluidized bed boiler comprising:

- a furnace and an air nozzle arrangement, the air nozzle arrangement comprising:
- several air nozzles spaced from each other in a longitudinal direction of the air nozzle arrangement;
- an air feed pipe that is connected to one of the air nozzles and that, with the air nozzle, limits an air feed duct;
- the air feed duct being configured to supply air to a furnace of the fluidized bed boiler; and
- a surface, wherein at least part of said surface is configured to protect at least part of at least one of, the air nozzle, and the air feed pipe,
- and
- wherein at least part of said surface is thermally insulated from at least one of , the air nozzle, and the air feed pipe;
- wherein at least one air nozzle is configured to supply air to a furnace of the fluidized bed boiler in a direction which forms an angle not larger than 80 degrees to a horizontal plane and forms an angle of at least 10 degrees to the longitudinal direction;

wherein at least 50% of the surface is arranged at an angle of at least 10 degrees to the horizontal plane, whereby the surface is configured to guide coarse material along said surface in such a way that liquid metal carried along with solids of the furnace does not solidify when it hits the surface, and the solids are guided along the surface downwards and to one side according to the shape of the surface, wherein the temperature of said surface is configured to be high when the fluidized bed boiler is in operation, whereby the solidification of molten material of the fluidized bed at the air nozzle arrangement is reduced, and the air flow produced by the air nozzle is configured to guide coarse material towards an ash removal zone of a grate or a coarse material outlet of the fluidized bed boiler; wherein the air nozzle arrangement is configured to supply combustion air to the furnace of the fluidized bed boiler.

2. The fluidized bed boiler of claim 1 wherein the temperature of said surface is configured to be higher than the temperature of one of the air nozzles when the fluidized bed boiler is in operation.

3. The fluidized bed boiler according to claim 1 comprising a plate comprising said surface, wherein said plate is replaceable, alone or together with other parts.

4. The fluidized bed boiler of claim 1 wherein said surface is configured to protect at least two air nozzles.

5. The fluidized bed boiler of claim 1 wherein at least part of the surface is arranged at least partly above said air nozzle.

6. The fluidized bed boiler according to claim 1 comprising a grate beam, the grate beam comprising:

the air nozzle arrangement;

an air beam, the air beam being configured to supply air to at least said air feed duct;

the air beam comprising walls and at least one heat exchanger pipe;

the heat exchanger pipe being provided in or on one of said walls; and wherein the one of said walls being arranged in contact with coarse material when the fluidized bed boiler is in operation, wherein the heat exchanger pipe is configured to cool the air beam and to recover heat from coarse material.

7. The fluidized bed boiler according to claim 6, wherein the grate beam has a profile form extending in the longitudinal direction, said air nozzles are arranged on a first upper side of said grate beam, the first upper side defining a height direction of the grate beam, the height direction extending from a second lower side of the grate beam, opposite to the first upper side, to the first upper side of the grate beam, the grate beam having a height in said height direction, and the grate beam having a width in a direction perpendicular to said height direction and perpendicular to said longitudinal direction, the height being greater than the width.

8. The fluidized bed boiler according to claim 6, comprising:

a grate;

a first air nozzle arrangement with several air nozzles spaced from each other in the longitudinal direction; and a second air nozzle arrangement with several air nozzles spaced from each other in the longitudinal direction of the second air nozzle arrangement, in which grate the second air nozzle arrangement is spaced from the first air nozzle arrangement in a cross direction transverse to the longitudinal direction, wherein at least one of an ash removal zone and a coarse material outlet is left between the first and second air nozzle arrangements, for removing coarse material from the fluidized bed boiler.

9. The fluidized bed boiler according to claim 8, wherein said at least one of an ash removal zone and a coarse material outlet, is limited by a wall, one direction of the wall forming an angle not larger than 5 degrees to a vertical direction, or at least 5 degrees to the horizontal direction.

10. A fluidized bed boiler according to claim 1, comprising a grate comprising several grate beams, the grate beams comprising air beams, said air beams having a profile form extending in the longitudinal direction, said air nozzles being arranged on a first upper side forming at least a part of the profile the first upper side of said air beam defining a height direction of the air beam, the height direction extending from a second lower side of the air beam, opposite to the first upper side, to the first upper side of the air beam, a width direction is defined perpendicular to said height direction and perpendicular to said longitudinal direction of the air beam, in which grate the grate beams are spaced from each other in said width direction, wherein an ash removal zone is left between at least two of the several grate beams;

wherein the fluidized bed boiler further comprising:

a duct or a funnel for collecting coarse material; in which fluidized bed boiler at least part of the coarse material in the fluidized bed is configured to flow along said surface of the air nozzle arrangement of the fluidized bed boiler, via said ash removal zone to said duct or funnel for collecting ash;

wherein at least part of said air nozzle or said air feed pipe is protected with said surface, at least part of said surface is thermally insulated from at least one of said air nozzle and said air feed pipe, wherein the solidification of molten solids on said surface is reduced, and a heat exchanger pipe of said grate beam is configured to cool the grate beam and to recover heat from the coarse material passing through said ash removal zone.

11. A method for removing coarse material from a fluidized bed boiler, the fluidized bed boiler comprising:

a furnace, several air nozzles spaced from each other in a longitudinal direction, an air feed pipe, a grate, and an ash removal zone or a coarse material outlet;

the method comprising:

supplying combustion air by an air nozzle to the furnace of the fluidized bed boiler;

removing coarse material from the fluidized bed boiler via the ash removal zone or the coarse material outlet;

protecting at least part of at least one of the air nozzle and the air feed pipe by a surface, of which at least part is thermally insulated from at least one of the air nozzle and the air feed pipe, guiding the coarse material along the surface of which at least 50% is arranged at an angle of at least 10 degrees to a horizontal plane, toward said ash removal zone or coarse material outlet in such a way that liquid metal carried along with the solids of the furnace does not solidify when it hits the surface, and the solids are guided along the surface downwards and to one side according to the shape of the surface and supplying air by the air nozzle to the furnace of the fluidized bed boiler in a direction towards said ash removal zone or coarse material outlet.

12. The method according to claim 11, further comprising guiding the coarse material along the surface towards said ash removal zone or coarse material outlet with an air flow produced by the air nozzle.

13. The method according to claim 11, wherein the temperature of said surface is higher than the temperature of said air nozzle.

14. The method according to claim 11, wherein said air nozzle is used for supplying combustion air to the fluidized bed boiler, and at least part of the surface is arranged at least partly above said air nozzle.

* * * * *